US006244568B1

(12) United States Patent
Patton

(10) Patent No.: US 6,244,568 B1
(45) Date of Patent: Jun. 12, 2001

(54) RESCUE SPREADING TOOL

(76) Inventor: Tommy L. Patton, 1495 W. 9th St., Ste. 101, Upland, CA (US) 91786

( * ) Notice: Subject to any disclaimer, the term of this patent is extended or adjusted under 35 U.S.C. 154(b) by 0 days.

(21) Appl. No.: 09/448,456

(22) Filed: Nov. 24, 1999

(51) Int. Cl.[7] ..... B66F 3/24

(52) U.S. Cl. ..... 254/93 R; 72/705; 254/93 H

(58) Field of Search ..... 254/93 H, 93 HP, 254/124, 104, 93 R; 29/252, 239; 81/302, 349, 383.5; 72/392, 705

(56) References Cited

U.S. PATENT DOCUMENTS 5,505,431 * 4/1996 Vitale ..... 254/93 R
5,542,646 * 8/1996 Bunyan ..... 254/93 R
5,622,353 * 4/1997 Painter et al. ..... 254/93 R
5,810,333 * 9/1998 Hickerson et al. ..... 254/93 R

FOREIGN PATENT DOCUMENTS

1004252 * 3/1983 (SU) ..... 254/93 R

* cited by examiner

*Primary Examiner*—David A. Scherbel
*Assistant Examiner*—Daniel Shanley
(74) *Attorney, Agent, or Firm*—Albert O. Cota

(57) ABSTRACT

A rescue spreading tool having a hydraulic cylinder (20) that provides a spreading, crushing or cutting motion. A stationary yoke (28) is attached to the cylinder and a pair of spreader arms (32) are also pivotally attached and are free to rotate in opposed directions. A pusher cam yoke (46) is formed integrally with to the ram (22) within the cylinder and engages the arms, thus pushing them apart when the ram is extended which provides an initial cam action. A pair of toggle links (58) are attached on both the top and bottom of the arms and pusher cam yoke and continue to push the arms apart in an outward direction, thereby producing a secondary thrust after the initial cam action is completed which spreads the arms to a maximum distance. When the ram is retracted the links close the arms through the secondary mode by reversing the procedure and continue to pull the arms together during the returning initial action.

19 Claims, 3 Drawing Sheets

RESCUE SPREADING TOOL

TECHNICAL FIELD

The invention generally pertains to tools which provide a spreading, crushing or cutting motion under high loads and more particularly to tools used for emergency rescue operations that are commonly referred to as "Jaws of Life"®.

BACKGROUND ART

As mankind has progressed, many of the methods and designs of commonplace life have become more advanced and varied. Vehicles are now the most prevalent mode of transportation, structures constructed of wood and metal are where we live and work, and even amusement parks, with rides that propel us at up to 100 mph, are where we spend our recreation time. Although these modern means undoubtably add a considerable positive influence to our lives, they do present their own unique problems.

One of the common aspects of the examples listed above, as well as many other items in our modern world, is that they all are constructed or made from materials designed to provide a high level of structural integrity. For the most part this level of structural integrity is not only useful for the design but also it provides a high level of protection. Unfortunately incidents occur that cause potentially dangerous situations.

For any person who works in an occupation that is responsible for rescuing and/or saving victims of accidents, their tools are often the only means by which to actually save a person's life. One of the most effective and widely used tools for rescuing a person is the "Jaws of Life"® type device. This device, of which there are several different design configurations, and can be powered by different means as well, are used to free a trapped and often injured victim from within an enclosed space. A frequent scenario which necessitates the "Jaws of Life"® is when a passenger in a vehicle is trapped within a crushed and mangled section of the vehicle after an accident. As a result of some accidents, especially those that occur at high speeds or between disproportionately sized vehicles, one or more of the vehicles involved may sustain such severe damage that the metal becomes deformed, thus creating extremely difficult removal of the passenger(s) within.

In the past, rescuers had to a attempt to pry the metal apart with a crowbar, or similar tool, or they would be forced to saw the metal open. Another method that was used in the past was a high-temperature torch to cut through the metal. Unfortunately, if there was any gasoline or other flammable liquid spilled or in the atmosphere, the probability for an explosion to occur as a result of this was very high. Regardless of whichever of these methods was employed they all shared one major drawback: the amount of time required to use and successfully finish with these tools was often so long that the victim or victims within the vehicle(s) sometimes suffered more injuries or even death due to the length of time they were trapped.

Another major drawback of current rescue devices is that in order to provide the necessary torques which is usually between 7,000 and 15,000 pounds, the device must have a high-level power source. This need directly effects the portability and ease-of-use characteristics of the device. It is clearly obvious that there is a need for a high-power, portable rescue device that is capable of being used by a single operator and that can be easily transported to the scene of an accident.

A search of the prior art did not disclose any patents that read directly on the claims of the instant invention, however the following U.S. patents are considered related:

| U.S. Pat. No. | INVENTOR | ISSUED |
|---|---|---|
| 5,956,992 | Patton | 28 September 1999 |
| 5,544,862 | Hickerson | 13 August 1996 |
| 5,425,260 | Gehron | 20 June 1995 |
| 5,297,780 | Hickerson | 29 March 1994 |

The U.S. Pat. No. 5,956,992 patent discloses a spreading, crushing or cutting device that is particularly adaptable for removing material from a vehicle in which is located a trapped accident victim. The device consists of a first arm assembly which functions in combination with an interlocking second arm. The first arm assembly and the second arm operate with a drive-mechanism yoke that pivotally attaches the lower ends on the first arm assembly and the second arm. The device also includes a drive yoke which includes a pair of cam pins that traverse a cam slot located on each arm. The drive yoke has a drive rod connected to a linear actuating mechanism. When the mechanism is in a retracted position, the first arm assembly and the second arm close, and when the mechanism moves upward into a non-retracted position, the two arms open.

The U.S. Pat. No. 5,544,862 and the U.S. Pat. No. 5,297,780 patents disclose a light-weight portable "Jaws of Life" spreading tool actuated by an electric motor. High torque at any position, with selectable spreading or cutting motions under high loads, is achieved by the use of a rotary, multiple-stage, speed-reducing gearbox driven by the motor. The gearbox contains an input stage from the electric motor running on a 12-volt DC power supply, and a compound planetary output stage. The arms or jaws of the device are separately driven, and for convenience are attached to external rings on the gears by heavy duty pins. The arms or jaws are removable for interchanging between cutting and spreading applications, or replacement with general purpose arms capable of both cutting and spreading.

The U.S. Pat. No. 5,425,260 patent discloses an accident rescue tool having a base, a base arm fixedly attached to the base, and a lifting arm pivotably attached to the base. A means for pivoting the lifting arm toward the base arm is provided, as is a first chain connected to the base arm at one end and a rigid vehicle component at the other end, and a second chain connected to the lifting arm at one end and a vehicle component at the second end. The pivoting means is connected to both the base arm and lifting arm to pivot the lifting arm so that the second chain causes the vehicle component to move in conjunction herewith.

For background purposes and as indicative of the art to which the invention relates, reference may be made to the following remaining patents found in the search.

| U.S. Pat. No. | INVENTOR | ISSUED |
|---|---|---|
| 5,301,533 | Jackson | 12 April 1994 |
| 4,886,635 | Forster et al | 12 December 1989 |
| 4,333,330 | Porter | 8 June 1982 |
| 3,570,835 | McPherson | 16 March 1971 |
| 2,447,401 | Ferguson et al | 17 August 1948 |

DISCLOSURE OF THE INVENTION

In this ever changing world of modern vehicle construction, there is a need for a small, powerful rescue tool. Due to the revised 1997 impact standards for passenger protection, vehicles have been updated by the addition of hardened reinforcing bars or strong metallic tubing inside the door structures to keep the doors from collapsing as a result of side impacts. Previously automobiles weighing approximately 5,000 pounds (2,270 kg) typically had a door that weighed from 100 to 150 pounds (45.4 to 68.1 kg). With present construction methods, a typical automobile door may weigh only 25 to 35 pounds (11.35 to 15.89 kg). A "Jaws of Life" type tool weighing 70 pounds (31.8 kg) and having a spread of up to 32 inches (81.28 cm) is capable of removing a 100 pound (45.4 kg) door with relative ease, by actually pushing the door away from the hinge at the front or the Nader Bolt at the rear of the door.

All of the "Jaws of Life" type rescue spreader tools have basically the same mechanical function which operates by the use of cylinders that require a hydraulic pressure of from 120,00 to 145,00 pounds per square inch (82,740 to 999,775 kPag), which is necessary to overcome the mechanical disadvantage created by the geometrical relationship caused by the length of the jaws. The jaws or spreader arms are typically made of aluminum and are relatively long, expanding to 32 inches (81.28 cm) at the tip. Due to the long length of the spreader arms they create about 11,000 pounds per square inch (75,845 kPag) of usable force at the tips, which is insufficient to break today's lightweight doors with forged or stamped chromemoly door hinges.

There is therefore a need for a relatively small, compact spreading tool having enough power to easily break the modern hardened hinges without relying on the mass or strength of the door itself.

Therefore, the primary object of the invention is to utilize a mechanical drive mechanism in a spreading tool that increases the usable power at the tips instead of decreasing the mechanical advantage, as is presently done with the exceptionally long arms. By using only 26,000 pounds per square inch (179,270 kPag) of cylinder force on a short arm, and through the use of cams and toggles to achieve 28,000 to 80,000 pounds (12,712 to 36,320 kg) of mechanical force the spreading tool would have more than enough strength to displace the newer doors and hinges.

An important object of the invention is that the spreading tool presented is small enough that it can be placed with the spreading tips just inside a door hinge, which would then allow the opening of the arms sufficiently to actually break the hinge away from the firewall without tearing any of the light sheet metal, plastic or carbon fiber material away from the framework of the door.

Another object of the invention is the use of both a linear angular cam and toggle linkage in the same device, thus creating an efficient initial cam thrust that would open the spreader arms 45 to 65 percent of their travel distance, with a toggle linkage continuing the opening action the balance of the travel distance, thereby optimizing the geometry of the mechanical advantage to its greatest potential.

Still another object of the invention is that the spreading tool opens to a distance of 10.75 inches (27.3 cm) at the tips of the spreader arms and yet is only 26.88 inches (68.28 cm) long, which is much easier and handier to use by rescue personnel.

Yet another object of the invention is that the spreading tool uses existing power units without modification, such as the Briggs 6.5, Kawasaki 8.3, Honda 13.0 power units etc. or larger units which are well known and in common usage.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
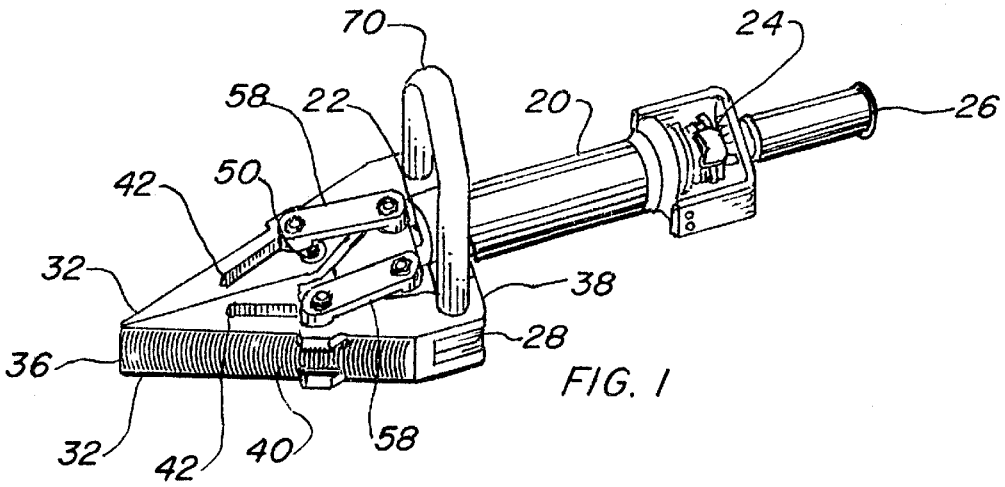
FIG. 1 is a partial isometric view of the preferred embodiment with the spreader arms in the closed position.
Figure 2:
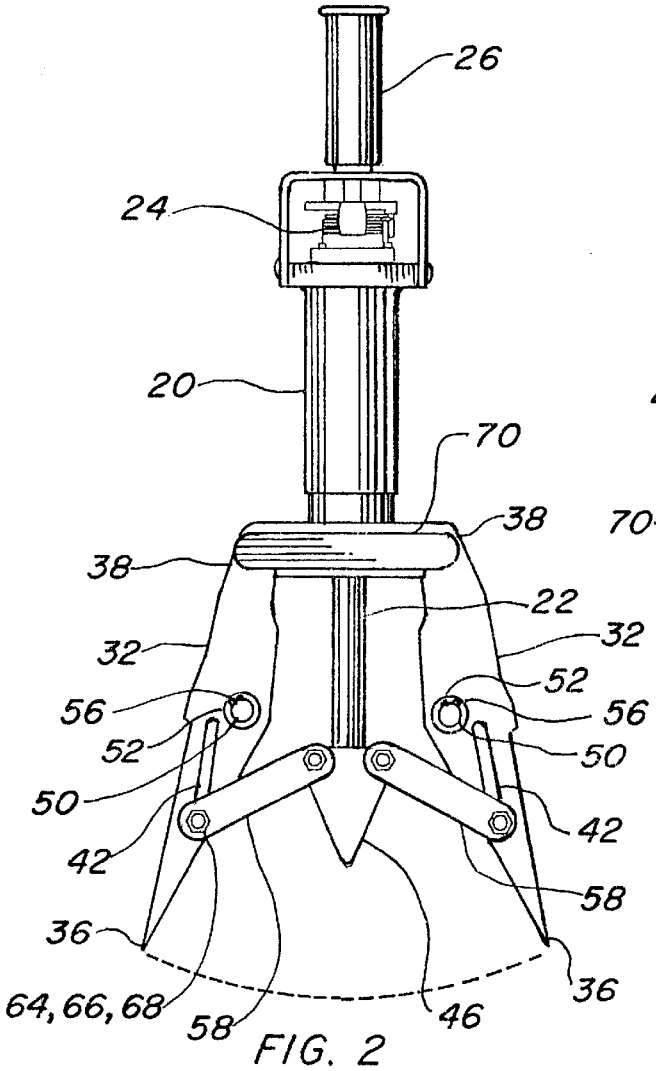
FIG. 2 is a top elevation view of the preferred embodiment with the spreader arms in the open position.
Figure 18:
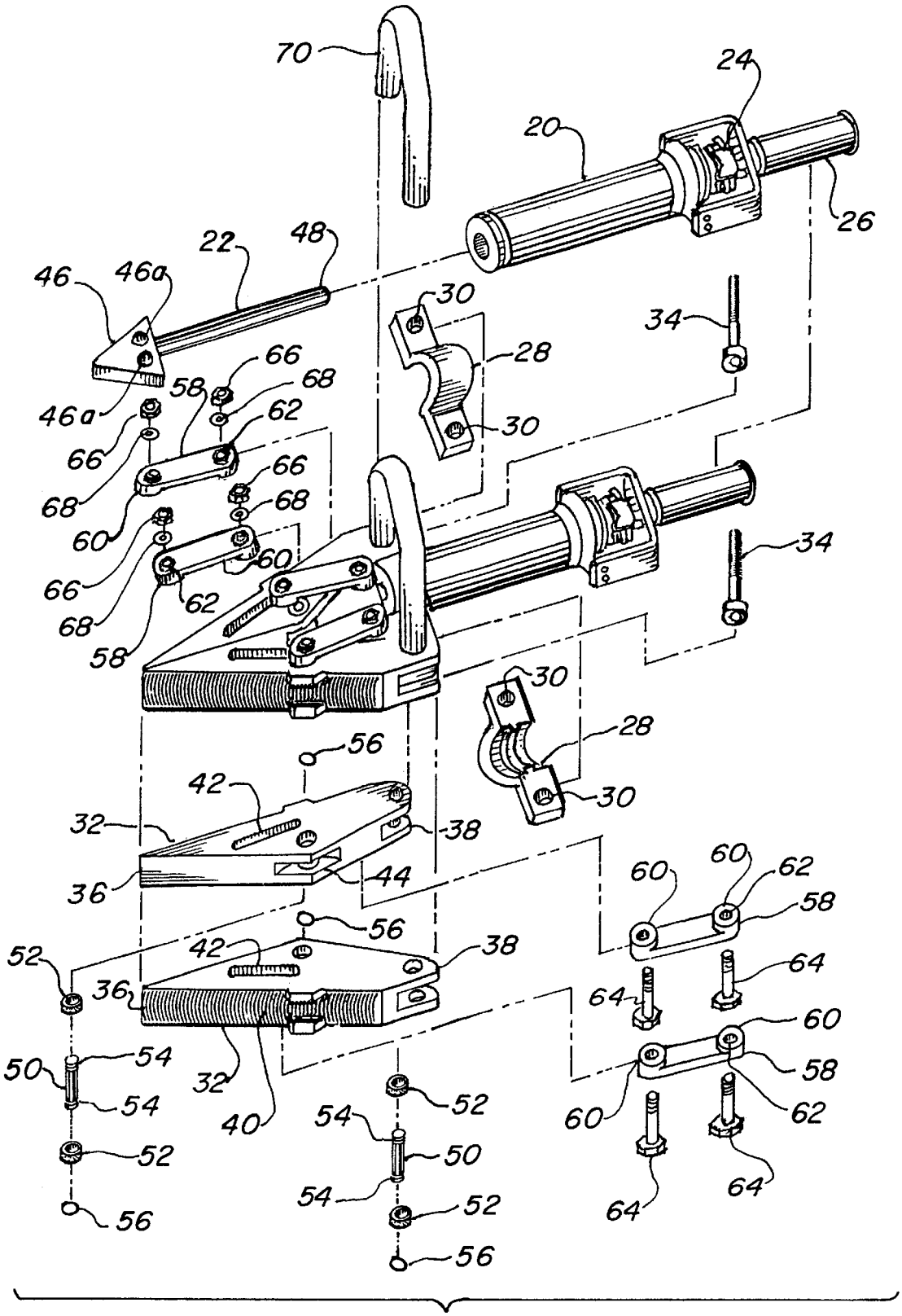
FIG. 18 is a exploded view of the preferred embodiment with the spreader arms in the closed position.

The best mode for carrying out the invention is presented in terms of a preferred embodiment for a rescue spreading tool. This preferred embodiment is shown in FIGS. 1 through 18 and is comprised of linear drive means in the form of a hydraulic cylinder 20 utilizhig a movable ram 22 which extends outward and retracts inward, thus creating a pushing and pulling action. It should be noted however that the hydraulic cylinder 20 is only the preferred means, as pneumatic cylinders, electric linear drive mechanisms, pyrotechnic devices or any drive that incorporates a ram or arm that moves in a linear direction may be used with equal ease and effectiveness. For convenience of operation, controls 24 for the cylinder are attached at the end of the cylinder 20 opposite the ram 22 as shown in FIGS. 1, 2 and 18. These controls 24 cause the ram 22 to extend or retract and are well known in the art and used in similar applications. For ease of handling the spreader tool, a rear handle 26 is attached directly to the hydraulic cylinder or specifically to the controls 24, which are housed within a bracket that is attached to the end of the cylinder. It should be noted however that the handle 26 and control bracket, in the configuration illustrated, are only the preferred manner of handling, as other manually held devices may also be used.

A stationary yoke 28 is connected to the hydraulic cylinder 20 at the ram end, thereby providing a mounting platform. This stationary yoke 28 consists of a pair of yoke half's, each in mirror image of the other and attached by clamping around the hydraulic cylinder as shown in FIG. 18. Further, one of the half's is illustrated removed from the tool in FIGS. 9–11, thus showing its detailed construction for at least one type of hydraulic cylinder. When the two yoke half's are combined, each of their ends form the mounting platform as illustrated in FIGS. 1 and 3, and each end has a mounting hole 30 through which other elements may be attached.

A pair of opposed spreader arms 32 are pivotally affixed to the stationary yoke 28 through the use of a clevis-like recess in each end of the arm, which interfaces upon the stationary yoke and is held rotatably in place with socket head screws 34 such that both arms are free to swivel from the stationary yoke 28. The spreader arms each have a first end 36 and a second end 38 with the first end 36 tapered to a point as shown in FIGS. 1, 2 and 18 and the second end 38 attached to the stationary yoke 28 as described above.

Figure 3:
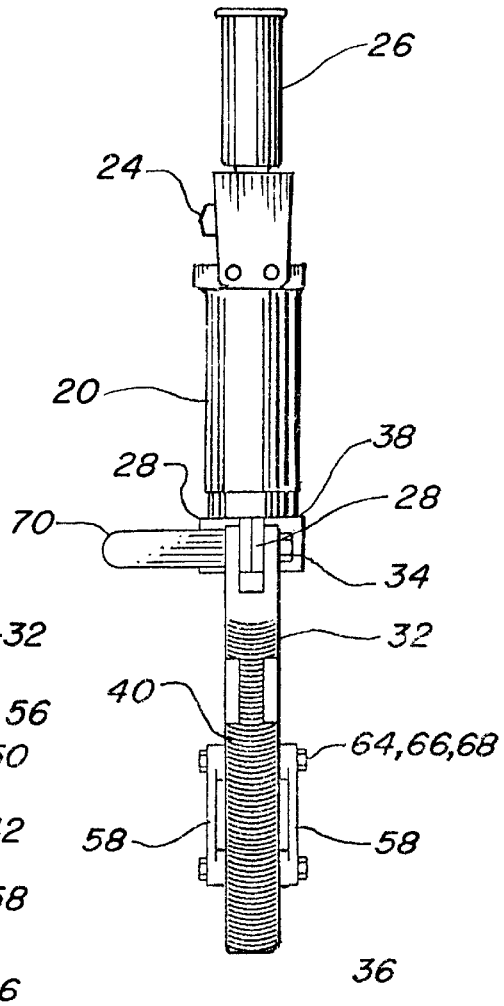
FIG. 3 is a right side view of the preferred embodiment with the spreader arms in the open position.
Figure 4:
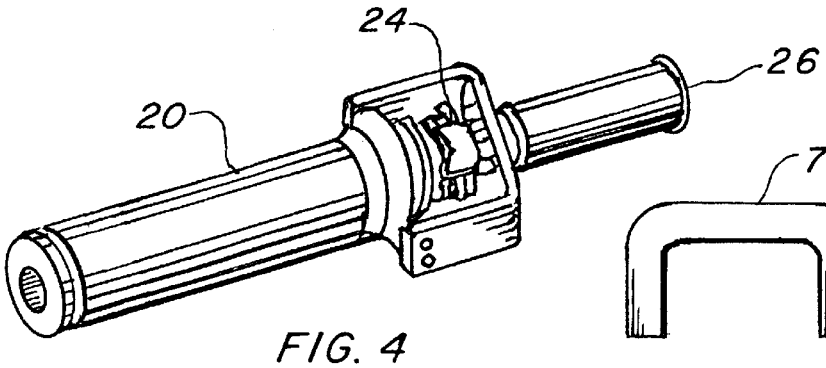
FIG. 4 is a partial isometric view of only the hydraulic cylinder including controls and handle.
Figure 5:
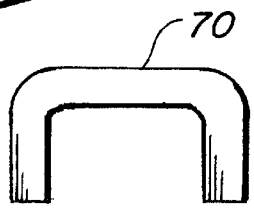
FIG. 5 is a front view of the forward handle, completely removed from the invention for clarity.
Figure 6:
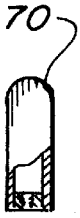
FIG. 6 is a right side view of the forward handle, completely removed from the invention for clarity.
Figure 15:
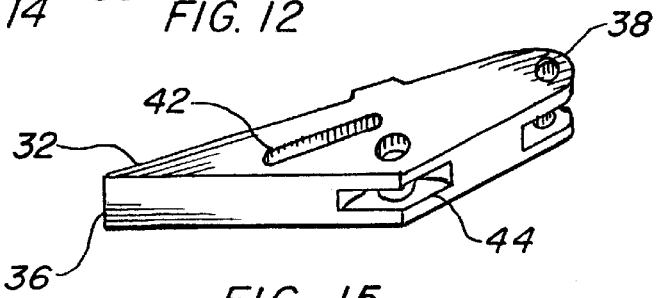
FIG. 15 is a partial isometric view of one of the spreader arms, completely removed from the invention for clarity.
Figure 16:
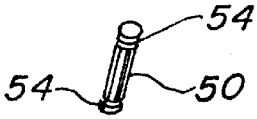
FIG. 16 is a partial isometric view of one of the roller pins, completely removed from the invention for clarity.
Figure 17:
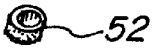
FIG. 17 is a partial isometric view of one of the oil impregnated bronze bearings, completely removed from the invention for clarity.

Each spreader arm 32 is preferably made of a stainless steel investment casting with curved, milled tooth file serration's 40 forming the outside edge, as shown in FIGS. 1, 3 and 15, which provides a non-slip surface for gripping the opposite sides of the arms as the tool expands. Each spreader arm includes a slot 42 therethrough as illustrated best in FIG. 15 that provides an attachment opening at an appropriate location relative to the overall shape of the arm. Each spreader arm 32 further includes a roller recess 44, as depicted in FIG. 15, disposed on the inner edge of the arm between the first end 36 and the second end 38, thus permitting clearance for other elements described to penetrate therein when axially spreading the arms apart.

Figure 7:
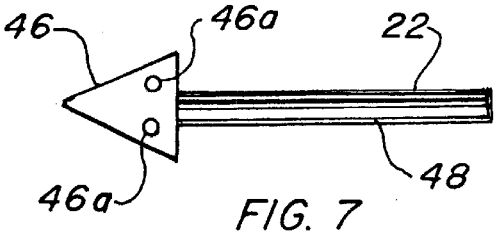
FIG. 7 is a plan view of the pusher yoke, completely removed from the invention for clarity.
Figure 8:
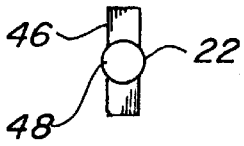
FIG. 8 is a right side view of the pusher yoke, completely removed from the invention for clarity.
Figure 9:
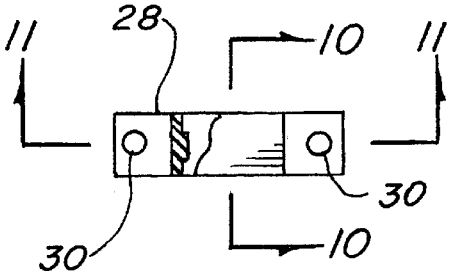
FIG. 9 is a cut away plan view of the stationary yoke, completely removed from the invention for clarity.
Figure 10:
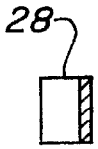
FIG. 10 is a cross sectional view taken along lines 10—10 of FIG. 9.
Figure 11:
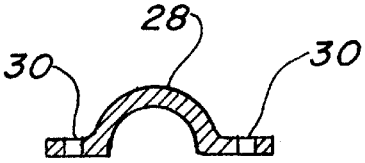
FIG. 11 is a cross sectional view taken along lines 11—11 of FIG. 9.

A pusher cam yoke 46 is integrally formed with the movable ram 22 of the linear driving means or, specifically the hydraulic cylinder 20, contiguously engaging opposed second ends 38 of the spreader arms 32. The cam yoke 46 has a triangular shaped body, as shown in FIG. 7, along with a cylindrical shaped shank 48 which is formed integrally therewith preferably using an investment casing. The combined parts together physically form the movable ram 22 of the hydraulic cylinder 20.

Roller means, in the form of a roller pin 50 captivated by a pair of oil-impregnated bushings 52, are disposed within each spreader arm 32 by pressing the bushings into each arm, thereby permitting the roller pins 50, within the bushings 52 positioned therein, to rotate freely and interface with the pusher cam yoke 46 as shown in FIG. 15. It may be easily understood that the pusher cam yoke 46 produces an initial cam action thrust for spreading the arms 32 away from each other when the pusher cam yoke 46 is urged in an outward direction from the hydraulic cylinder 20. The cam yoke 46 is narrow enough to penetrate into the roller recess 44 which provides clearance and allows the yoke's triangular shaped sides to slide unhindered on the roller pins 50, as depicted schematically in FIG. 18. The roller pins 50 contain a groove 54 adjacent to each end of the pin with a snap ring 56 disposed within each groove 54, for retention of the pin 50 within each spreader arm 32, as shown expanded in FIG. 18.

Figure 12:
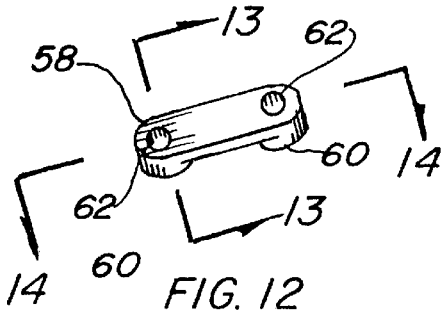
FIG. 12 is a partial isometric view of one of the cam links, completely removed from the invention for clarity.
Figure 13:
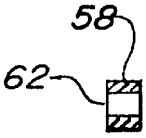
FIG. 13 is a cross sectional view taken along lines 13—13 of FIG. 12.
Figure 14:
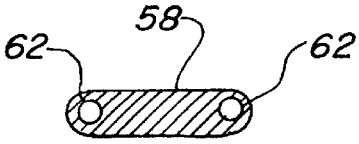
FIG. 14 is a cross sectional view taken along lines 14—14 of FIG. 12.

A pair of toggle links 58 are attached on one end of the stationary yoke 28 and on the other end to the pusher cam yoke 46 on both the top and bottom of the yoke 46, thus producing a secondary thrust after the initial cam action is completed which spreads the arms 32 to a maximum distance within the tools geometrical limits. The toggle links 58 further have a rectangular shape with raised bosses 60 on one side at opposed ends as shown in FIGS. 12–14. The bosses 60 have a bore 62 therethrough which penetrates each link 58 for clearing the protruding ends of the roller pins 50 that are housed within the spreader arms 32. The toggle links 58 are attached through the bores 62 in a pivotal manner with threaded screws 64 and nuts 66 and washers 68 to a pair of connecting holes **46*a* in the pusher cam yoke 46 and slots 42 as shown in FIGS. 1–3 and 18**.

A forward handle 70 is attached to the stationary yoke 28 for holding the tool with one hand, while the other hand grips the rear handle 26. The forward handle 70 has threaded holes 72 at each terminating end for attachmuent with the socket head screws 34 that penetrate the stationary yoke 28 and spreader arms 32.

It may be visualized that the tool has linear driving means in the form of a hydraulic cylinder 20, or the like, that provides a mechanical pushing and a pulling action. The spreader arms 32 are attached to the stationary yoke 28 and also the cylinder 20, and an initial thrust is produced for spreading the arms 32 away from each other when the ram 22 in the cylinder 20 is urged outward. A secondary thrust is produced after the initial thrust action is completed, thus spreading the arms 32 to a maximum distance within the tools geometrical boundaries.

Much of the novelty of the invention is realized in the way the arms 32 open in the two-step thrust, in that when the ram 22 is extended the pusher cam yoke 46 comes in contact with the roller pins 50 which push the arms 32 open but do not have the ability to close them. Further, the secondary thrust is achieved by the toggle links 58 that are attached to both the pusher cam yoke 46 and the arms 32 through slots 42 that permit the links 58 to simply slide along the arms 32 when the initial action is performed. When this action is completed the links 58, having reached the limit of their travel in the slots 42, begin to complete the ann opening process in the secondary thrust mode. When the ram 22 is retracted the links 58 close the arms 32 through the secondary mode by reversing the procedure and continue to pull the arms 32 together during the initial action bypassing the direct use of the roller pins 50, thus completing the operational mode of the tool.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

I claim:

1. A dual thrust acting rescue spreader tool comprising:

a) linear driving means having a moveable ram, creating a pushing and a pulling action, b) a stationary yoke connected to said linear driving means providing a mounting platform thereupon, c) a pair of opposed spreader arms each having a first end and a second end, with each first end pivotally affixed to said stationary yoke such that both arms are free to swivel from said stationary yoke, d) a pusher cam yoke on one end of the movable ram of said linear driving means having a triangular shaped body contiguously engaging opposed spreader arms first ends, e) roller means disposed within each spreader arm rotatably interfacing with the triangular shaped body pusher cam yoke producing an initial cam action thrust of from 45% to 65% of said spreader arms travel for spreading the arms away from each other when the pusher cam yoke is urged in an outward direction from the linear driving means, and f) a plurality of toggle links each attached on one end to said stationary yoke and on the other to said pusher cam yoke producing a secondary thrust after the initial cam action is completed spreading the arms to a maximum distance within the tools geometrical limits.

2. The rescue spreader tool as recited in claim 1 wherein said linear driving means further comprising a hydraulic cylinder having the ram formed integrally with said pusher cam yoke.

3. The rescue spreader tool as recited in claim 2 further comprising a rear handle attached directly to said hydraulic cylinder for gripping the tool at one end with one hand.

4. The rescue spreader tool as recited in claim 2 wherein said stationary yoke further comprises a pair of yoke half's each in mirror image of the other attached in clamping fashion around said hydraulic cylinder at an end containing the ram.

5. The rescue spreader tool as recited in claim 1 wherein each spreader arm further comprises a steel forging with curved milled tooth file serration's on an outside edge and the arms acting in concert, to provide a non slip surface for gripping opposite sides of the tool.

6. The rescue spreader tool as recited in claim 1 wherein each spreader arm further having a slot therethrough providing an attachment opening for said toggle links when axially spreading the arms apart during the secondary thrust of the tool and retracting the spreader arms during both the secondary and initial thrust mode.

7. The rescue spreader tool as recited in claim 1 wherein each spreader arm further having a roller recess therein disposed on an inside edge of the arm between the first end and the second end permitting said pusher cam yoke to penetrate the arm through a recess for clearance and entry of said roller cam means.

8. The rescue spreader tool as recited in claim 1 wherein said pusher cam yoke further comprising said triangular shaped body having a integrally formed cylindrical shank constituting the movable ram of the linear drive means.

9. The rescue spreader tool as recited in claim 1 wherein said roller means further comprising a roller pin captivated by a pair of oil impregnated bushings pressed into each spreader arm, thus permitting the roller pins to rotate freely within and mate with the pusher cam yoke.

10. The rescue spreader tool as recited in claim 9 wherein said roller pins having a groove adjacent to each end with a snap ring disposed within each groove for retention of the pin within the spreader arm.

11. The rescue spreader tool as recited in claim 1 wherein said toggle links further comprising a rectangular shape with raised bosses on one side at opposed ends, said bosses having a hole therethrough, thereby penetrating each link for clearing the roller means that are housed within the spreader arms.

12. The rescue spreader tool as recited in claim 1 further comprising a forward handle attached to the stationary yoke for holding the tool with one hand.

13. The rescue spreader tool as recited in claim 12 wherein said forward handle further having threaded holes at each terminating end for attachment with threaded fasteners to the stationary yoke.

14. A dual thrust acting rescue spreader tool comprising:

a) linear driving means, providing a pushing and a pulling action, b) a stationary yoke connected to said linear driving means, c) a pair of spreader arms pivotally affixed to said stationary yoke such that both arms are free to swivel, d) a pusher cam yoke extending from said linear driving means, contiguously engaging the spreader arms, producing an initial cam action thrust of from 45% to 65% of said spreader arms travel for spreading the arms away from each other when the pusher cam yoke is urged in an outward direction from the linear driving means, and e) a plurality of toggle links each attached on one end to said stationary yoke and on the other to said pusher cam yoke producing a secondary thrust after the initial cam action is completed.

15. A dual thrust acting rescue spreader tool comprising:

a) linear driving means, providing a pushing and a pulling action, b) opposed spreader arms pivotally connected to said linear driving means, c) initial thrust means extending from said linear driving means producing an initial cam action thrust for spreading the arms away from each other when the linear drive means is urged outwardly, and d) secondary thrust means attached to both the linear drive means and the spreader arms producing a secondary thrust after the initial thrust action is completed spreading the arms to a maximum distance within the tools geometrical boundaries.

16. The rescue spreader tool as recited in claim 15 wherein said linear driving means further comprising a hydraulic cylinder having a ram extendible therefrom.

17. The rescue spreader tool as recited in claim 16 wherein said hydraulic cylinder further comprising a pusher cam yoke having a triangular shaped body with an integrally formed cylindrical shank constituting the movable ram of the linear driving means.

18. The rescue spreader tool as recited in claim 17 wherein each spreader arm further comprising a roller disposed therein slideably interfacing with the pusher cam yoke such that when the ram is urged outward the cam yoke impinges upon the rollers and spreads the arms, thus achieving the initial cam action of from 45% to 65% of said spreader arms travel spreading the arms apart.

19. The rescue spreader tool as recited in claim 15 wherein said secondary thrust means further comprising a plurality of toggle links jointly attached to the spreader arms and the linear driving means accomplishing a secondary thrust action after a primary action is completed with said arms having slots therein through which said toggle links attach, thereby providing a bypass movement during the primary action and engaging for the secondary action.

* * * * *